United States Patent [19]

Rathmell

[11] 3,968,578

[45] July 13, 1976

[54] SKI BOAT WITH ADJUSTABLE RIGIDITY

[76] Inventor: Richard K. Rathmell, 12 Pine Tree Road, Ramsey, N.J. 07446

[22] Filed: June 19, 1975

[21] Appl. No.: 588,203

[52] U.S. Cl. ..... 36/121

[51] Int. Cl.[2] ..... A43B 5/04

[58] Field of Search ..... 36/2.5 R, 2.5 AL, 50, 36/121

[56] References Cited

UNITED STATES PATENTS

| | | | |
|---|---|---|---|
| 3,535,800 | 10/1970 | Stohr | 36/2.5 AL |
| 3,807,060 | 4/1974 | Hanson et al. | 36/2.5 AL |
| 3,832,792 | 9/1974 | Kastinger | 36/2.5 AL |

*Primary Examiner*—Patrick D. Lawson

[57] ABSTRACT

A hinged ski boot with relatively great flexibility in the forward-backward direction, as is preferred for walking and a stride type of skiing, and means to be substantially stiffened, as is preferred for down-hill skiing, by the addition of a removable interlocking stiffening collar, wherein the stiffening collar can be attached or detached easily by the skier.

6 Claims, 1 Drawing Figure

SKI BOAT WITH ADJUSTABLE RIGIDITY

CROSS REFERENCE

Figure 1:
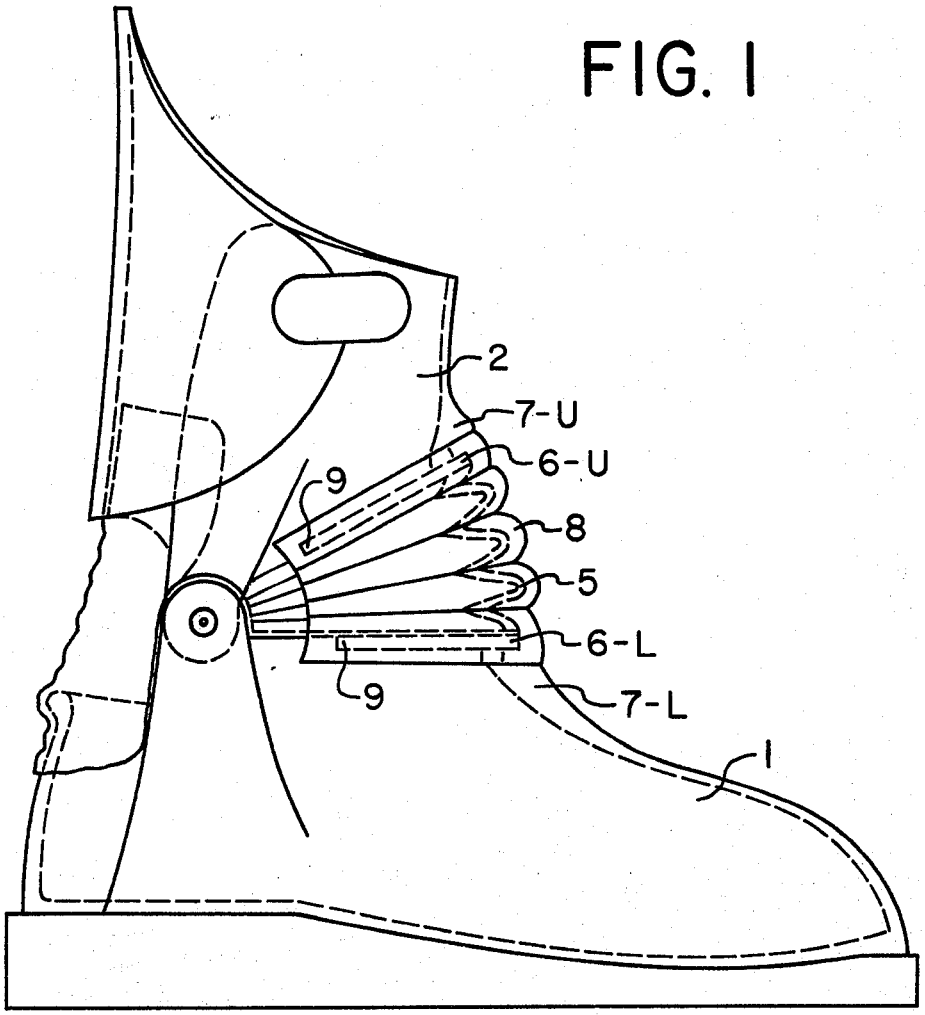

The copending application Ser. No. 588,204, titled "Molded hinged and corrugated ski boot", filed simultaneously with this application on June 19, 1975.

BACKGROUND OF THE INVENTION

Ski boots have evolved considerably from the leather boots that were used until less than ten years ago. Elastomeric polymers have by now virtually replaced leather. Modern ski boots are generally more rigid and higher to give improved performance for down-hill skiing. Several boot designs incorporate hinges between a foot-covering section and a separately formed section that can be tightened around the leg. These hinges allow the boot to be desirably rigid in the latteral direction but independently more flexible in the forward-backward direction. Some of these designs incorporate hardware to adjust the flexibility or stiffness. For example some of the U.S. Pat. Nos. concerned with this are: 3,619,914; 3,713,231; 3,747,335; 3,775,872; and 3,822,491. Other designs without hinges have also been concerned with adjustment in rigidity. U.S. Pat. Nos. 3,807,060 and 3,832,792 are examples.

However there still is no commercially successful and available boot that the skier can easily and quickly change from a very flexible boot that is preferred for walking and a stride type of skiing to some much more rigid boot that is preferred for down-hill skiing. Mechanical latches tend to be complex and/or expensive to accomodate the relatively large forces that they are subjected to during skiing.

The object of this invention is an improved type of ski boot that is relatively simple to mold and manufacture, wherein the boot has means to permit the skier to quickly and conveniently change its rigidity to suit his immediate needs.

DESCRIPTION OF INVENTION

In common with many ski boots, the subject boot has a foot-holding section 1 and a leg-holding section 2 connected to section 1 by hinges. These sections, as illustrated in FIG. I, are part of a basic boot shell that is relatively very flexible in a forward-backward direction, and relatively stiff in a latteral direction. Also in common with modern high top, high performance boots, means are provided to secure the skier's lower leg, heel, and ball of foot so that they are effectively prevented from moving loosely within the boot.

As illustrated in FIG. I, one unique feature of the subject boot is that the basic boot shell has specific projections and/or indentations that are formed to interlock with corresponding indentations and/or projections on a separate and detachable stiffening member. These projections are shear resistant and are capable of transmitting the forces that occur when a skier leans forward or backward in a stiff ski boot. For example, there may be projecting lips such as 6—u on the upper section 2 and 6—1 on the lower section 1, and the corresponding indentations between shoulder 7—u and 6—u, and between shoulder 7—1 and 6—1. Preferably these projections and/or indentations are integrally molded with the sections that comprise the basic boot shell.

Another unique feature of the subject boot is the separately formed stiffener 8 which is formed to interlock with the projections and/or indentations on the basic boot shell. For example, stiffener 8 may be formed like a half collar to fit across the front of the boot, almost from hinge to hinge. Means are provided to hold the stiffener in a functioning interlocked position. For example, the shear resistant lips 6—u and 6—1 may be sharply terminated short of the hinge, as at point 9, so that an elastomeric stiffener may be pressed over the ends of the projecting lips and thereby be latched in a functioning position until the skier pulls on a side of the stiffener to unlatch it. Other fastening means such as conventional snap-fasteners, or cords or straps that pass behind the heel can also be utilized to enable the skier to quickly attach or detach the stiffener.

It will be appreciated that a basic boot shell can be provided with different stiffeners having various modulii of elasticity and with a greater or lesser degree of forward lean for the boot in an unstressed position. The versatility of the boot is thereby enhanced.

The stiffeners typically will be molded from an elastomeric material selected to perform well when cold, with a strength, toughness and stiffness that does not change appreciably with a change in temperature over the temperature range that ski boots may be exposed to. A urethane polymer such as du Pont's "Adiprene" is an example of a good material.

Because the boot often will be used without the stiffener interlocked in a functioning position, it is preferable to provide means to keep snow from entering the basic boot shell between sections 1 and 2. A very flexible section 5 may be molded with relatively deep corrugations to seal the space between sections 1 and 2 in front of the hinges, and a flexible cover may be prepared to seal the corresponding space behind the hinges. Section 5 may be integrally molded with section 2 and then attached to section 1, or vise-versa, or it may be molded separate from both sections and attached to both.

If, in place of the conventional pinned hinges that connect sections 1 and 2, there are integrally molded elastomeric hinges as described in a copending application, the very flexible snow guard section 5 may also be integrally molded with the basic boot shell to give substantial economy in manufacturing costs.

Within the scope of this invention various materials may be used for the basic boot shell, and the stiffener may be made from the same or other materials. Various configurations may be employed to effectively interlock the stiffener with the basic boot shell, but it is expected that the stiffener will function to resist motion forward as well as backward, and that shear resisting projections will transmit the forces encountered.

What is claimed is:

1. A ski boot which by itself is relatively flexible in a forward-backward direction, but can be stiffened conveniently by the addition of a removable interlocking stiffening member, wherein the boot has elements that include:

a. a lower section that is relatively stiff and adapted to cover and hold the skier's foot within said section, b. an upper section that is relatively stiff and adapted to hold the skier's lower leg above the ankle within said section, c. hinges that connect the said upper section to the said lower section in a manner that allows the upper section to pivot in a forward-backward direction, d. a flexible section located in the space forward of the hinges and between the upper section and the lower section, and the boot is uniquely characterized by means provided for a removable stiffening member to be interlocked over the said flexible section and to transmit either compressive or tensile forces from the upper section to the lower section when the upper section is strained in either a forward or backward direction, wherein the said means are shear-resistant projections that interlock into corresponding indentations, and the said projections may extend from the boot sections into the stiffening member or vise-versa from the stiffening member into the boot, and means are provided to hold the stiffening member in a functioning position when the skier prefers the boot to be relatively stiff, or to remove the stiffening member when a relatively flexible boot is preferred.

2. A removable stiffening member for a ski boot, wherein the ski boot by itself is relatively flexible in a forward-backward direction, but can be stiffened conveniently by the addition of the said stiffening member, and the boot has elements that include:

a. a lower section that is relatively stiff and adapted to cover and hold the skier's foot within said section, b. an upper section that is relatively stiff and adapted to hold the skier's lower leg above the ankle within said section, c. hinges that connect the said upper section to the said lower section in a manner that allows the upper section to pivot in a forward-backward direction, d. a flexible section located in the space forward of the hinges and between the upper section and the lower section, and the stiffening member is characterized by its means to be interlocked to the said upper section and to the said lower section over the said flexible section and to transmit either compressive forces or tensile forces from the upper section to the lower section when the upper section is strained in a forward or backward direction, wherein the said means are shear-resistant projections that interlock into corresponding indentations, and the said projections may extend from the stiffening member into the boot sections or vise-versa from the boot sections into the stiffening member, and means are provided to hold the and member in a functioning force-transmitting position or to permit its removal.

3. A removable stiffening member as in claim 2 wherein the stiffening member is molded from an elastomeric material, and is further shaped with latteral corrugations wherein the lines of these corrugations extend toward the hinges of the boot.

4. A ski boot as in claim 1 wherein the shear-resistant projections are a set of lips, with a lip extending part way around the lower part of the upper section, and a lip near the top part of the lower section, and the stiffening member has a corresponding set of indented grooves which can recieve the set of lips, and the ends of the lips provide a latching means to hold the stiffening member in a functioning position.

5. A ski boot as in claim 1 wherein the said lower section, the flexible section, the upper section, and the hinges are integrally molded from an elastomeric polymer, and the stiffening member is separately molded in a shape to bridge the flexible section and to transmit forces from the upper section to the lower section by means of interlocking shear-resistant projections that extend from the boot into corresponding indentations in the stiffening member, and means are provided to hold the stiffening member in a functioning force-transmitting position or to allow its removal.

6. a ski boot as in claim 1 wherein the said lower section, upper section, hinges, and flexible section are all integrally molded from an elastomeric polymer, and the stiffening member is separately molded in a shape to bridge the flexible section and to transmit both compressive forces and tensile forces from the upper section to the lower section of the boot when the upper section is strained to pivot on the hinges, and the means to transmit these forces include shear-resistant projections that fit into corresponding indentations, and means are provided to hold the stiffening member in a functioning force-transmitting position or to permit its removal.

* * * * *